US006281921B1

(12) United States Patent
Sugaya et al.

(10) Patent No.: US 6,281,921 B1
(45) Date of Patent: Aug. 28, 2001

(54) METHOD FOR TREATING THE SURFACE OF THERMAL PRINTING HEADS

(75) Inventors: Kengo Sugaya; Terutoshi Nakao, both of Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/503,337

(22) Filed: Feb. 14, 2000

(30) Foreign Application Priority Data

Feb. 15, 1999 (JP) ..... 11-036070

(51) Int. Cl.[7] ..... B41J 2/335

(52) U.S. Cl. ..... 347/203

(58) Field of Search ..... 347/202, 203, 347/200

(56) References Cited

U.S. PATENT DOCUMENTS 6,028,618 * 2/2000 Defieuw et al. ..... 347/202

* cited by examiner

*Primary Examiner*—Huan Tran
(74) *Attorney, Agent, or Firm*—Fitch, Even, Tabin & Flannery

(57) ABSTRACT

A thermal head is provided which comprises an insulation substrate, a heat-generating resistor on the insulation substrate, a conductive layer for supplying electric power thereto, and a protective layer provided thereon. In the thermal head, the protective layer is surface-treated with a water- and oil-repellent and heat-resistant organosilicon-containing compound to provide a contact angle with respect to water of 95 degrees or more. The organosilicon-containing compound is preferably a fluoroalkyl silane with a fluorinated carbon chain length of 6 to 10 carbon atoms, having a hydrolyzable reactive group at a terminal thereof. The compound is strongly bonded to the protective layer via a silanol group by heat-treatment at 50° C. or more. The protective layer surface may be properly pretreated with an organosilicon compound having an isocyanate group bonded to a silicon atom.

25 Claims, 1 Drawing Sheet

METHOD FOR TREATING THE SURFACE OF THERMAL PRINTING HEADS

BACKGROUND OF THE INVENTION

1. Field of the Invention

The present invention relates to a thermal head which is surface-modified to have a low surface tension without inhibiting the heat transferability thereof. More particularly, it relates to a thermal head capable of maintaining excellent perforatability over an extended period of time in plate-making of heat-sensitive stencil sheets.

2. Description of the Prior Art

There has been conventionally known a plate-making method using a thermal head as a plate-making method of heat-sensitive stencil sheets. In this plate-making method, a thermoplastic resin film side of a heat-sensitive stencil sheet is brought into contact with the thermal head to melt and perforate the thermoplastic resin film at portions corresponding to an image area of a manuscript by the application of heat of the thermal head.

However, when plate-making is continuously carried out with this method, the thermal melt of the film undesirably adheres to the surface of the thermal head, and hence the thermal perforatability of the thermal head is gradually reduced.

In general, thermal heads are classified into thin film type ones, thick film type ones, semiconductor type ones, and the like based on their respective structures. As shown in FIG. 1, a thin film type thermal head has a layered structure which is roughly divided into an insulation substrate 1, a heat-generating resistor 2 provided on the insulation substrate 1, a conductive layer 3 connected to the heat-generating resistor 2 for supplying electric power thereto, and a protective layer 4 covering both the heat-generating resistor 2 and the conductive layer 3. As shown in FIG. 2, a thick film type thermal head also has the similar layered structure which is roughly divided into an insulation substrate 1, a conductive layer 3 and a heat-generating resistor 2 provided on the insulation substrate 1, and a protective layer 4 covering the conductive layer 3 and the heat-generating resistor 2. Thus, the surface of the thermal head generally denotes the surface of the protective layer 4.

Materials used for the protective layer 4 are inorganic materials with relatively good heat transferability such as $Ta_2O_5$, $SiO_2$, SiON, and $Si_3N_3$. However, such inorganic materials have high surface tension because of their high surface free energy, which makes the thermal melt of the film more likely to adhere to the surface of the thermal head.

In view of the foregoing circumstances, it has been proposed that a water- and oil-repellent and heat-resistant resin layer is further provided on the surface of the thermal head, that is, on the protective layer 4 to prevent the adhesion of the thermal melt of the film onto the surface (see Japanese Utility Model Publication No.Hei 4-7967, Japanese Patent Application Laid-Open Nos.Sho 60-2382, 60-178068, 62-48569, and the like). Such a resin layer is typically formed with fluororesin such as Teflon (tradename of Du Pont Corp.: polytetrafluoroethylene). Coating of the fluororesin on the surface of a thermal head generally requires the following procedure. First, a dispersion containing 50–60% solid polytetrafluoroethylene is prepared. Then, the dispersion is applied onto the surface of the thermal head, predried, and heated up to about 350° C.

The fluororesin layer is excellent for ensuring the lower surface tension of the thermal head surface. However, since the treatment process (heat-treatment process) thereof applies heavy thermal load to the electronic components attached to the thermal head, it cannot be said to be a simple and suitable treatment method. Further, the fluororesin has also presented a problem in terms of its insufficient adhesion to the glass material of the protective layer.

Moreover, since the resin layer is a coating layer formed of a resin, it has a thickness of about 1 $\mu$m even when thinly applied, and hence it inhibits efficient heat transfer from a heat-generating resistor to the surface. Further, there is also a limit to enhancement of the surface smoothness by making the film thickness of the resin layer uniform. Actually, the units of the resulting thickness and surface roughness are of the micron order.

Especially, when the plate-making of heat-sensitive stencil sheets is conducted with such a thermal head, the irregularities of the resin layer formed on the thermal head surface inhibit the adhesion between the thermal head and the heat-sensitive stencil sheet, thereby reducing the heat transferability. Consequently, uniform perforations of the heat-sensitive stencil sheet cannot be ensured.

SUMMARY OF THE INVENTION

In view of the foregoing, it is therefore an object of the present invention to prevent the adhesion of thermal melt to a thermal head by lowering the surface tension of a protective layer while maintaining the heat transferability from a heat-generating resistor to the surface thereof and the smoothness of the protective layer of the thermal head.

According to the present invention, the object is accomplished by a thermal head comprising: an insulation substrate; a heat-generating resistor provided on the insulation substrate; a conductive layer connected to the heat-generating resistor for supplying electric power thereto; and a protective layer provided on the heat-generating resistor and the conductive layer, wherein the protective layer is surface-treated with a water- and oil-repellent and heat-resistant organosilicon-containing compound.

The protective layer of the thermal head is generally comprised of glass materials containing $Ta_2O_5$, $SiO_2$, SiON, $Si_3N_3$, and the like. Therefore, the surface of the protective layer can be chemically modified by using an organosilicon-containing compound such as a silane compound as the water- and oil-repellent and heat-resistant compound which serves as a surface treatment agent. Such an organosilicon-containing compound is hydrolyzed by moisture in an aqueous solution or air, or moisture adsorbed to the inorganic material surface in the presence of a hydrolytic catalyst to form a silanol group (Si—OH) rich in reactivity. Since the silanol group is a reactive group which can be adsorbed onto or chemically bonded to the inorganic material surface, the surface of the protective layer can be chemically modified by using the organosilicon compound in the surface treatment of the protective layer comprised of glass materials of the thermal head. It is confirmed that the contact angle of the protective layer surface with respect to water can be improved up to 95 degrees or more by this surface treatment according to the present invention. Further, since the silanol group combines with an OH group present on the solid surface, it is possible to surface-treat protective layers of every material into a water- and oil-repellent state so long as the protective layers are comprised of materials capable of providing the OH groups thereon.

Therefore, according to another aspect of the present invention, there is provided a surface treatment method of a thermal head, comprising: a step of coating a protective layer of the thermal head with water- and oil-repellent and heat-resistant organosilicon-containing compound having a hydrolyzable reactive group at a terminal thereof in the presence of a hydrolytic catalyst.

Thus, according to the present invention, the water- and oil-repellent and heat-resistant organosilicon-containing compound is bonded to the surface of the protective layer of the thermal head to form a coat on the molecular level, i.e., to chemically modify the surface thereof into a water- and oil-repellent state. Accordingly, the heat transferability of the thermal head is not adversely affected at all.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
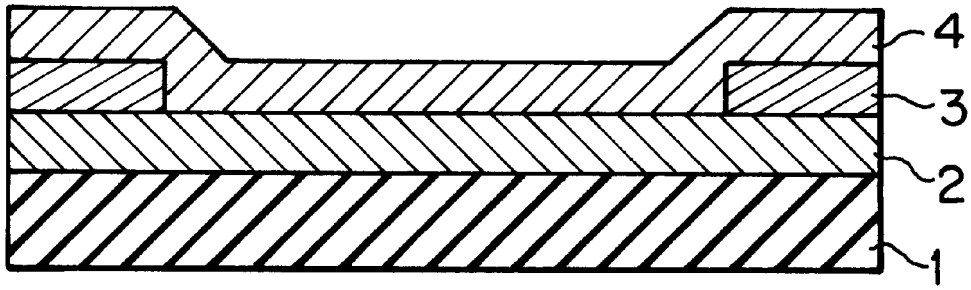
FIG. 1 is a cross sectional view of a conventional thin film type thermal head.

The water- and oil-repellent and heat-resistant organosilicon-containing compound used in the surface treatment of a protective layer of a thermal head in the present invention is not particularly limited so long as it imparts water- and oil-repellency to the thermal head surface. Such compounds have recently been provided in the form of various compositions as water- and oil-repellent treatment agents for glass. Typical examples of the compounds include fluoroalkyl, silane having a hydrolyzable reactive group at a terminal thereof, represented by the following general formula (1):

$$CF_3(CF_2)_m(CH_2)_nSiR_pX_{3-p} \quad (1)$$

(where R is a substituted or non-substituted monovalent hydrocarbon group; X is a hydrolyzable group; m is an integer of 5 to 10; n is an integer of 2 to 10; and p is an integer of 0 to 2).

Specific examples of the substituted or non-substituted monovalent hydrocarbon group (R) include alkyl groups such as methyl, ethyl, propyl, and hexyl groups, alkenyl groups such as vinyl and allyl groups, cycloalkyl groups such as cyclopentyl and cyclohexyl groups, aryl groups such as phenyl and tolyl groups, and the groups obtained by partially substituting each of these groups with a halogen atom, an amino group, a hydroxyl group, an alkoxy group, or the like.

Specific examples of the hydrolyzable group (X) include alkoxy groups such as methoxy, ethoxy, isopropoxy, n-propoxy, and n-butoxy groups, aminoxy group, ketoxime group, acetoxy group, amide group, or alkenyloxy group. Especially, a methoxy group or an ethoxy group among the alkoxy groups is preferred because good pot life and reactivity, and good water- and oil-repellency can be provided.

Specific examples of the fluoroalkyl silane include $CF_3(CF_2)_5CH_2CH_2Si(OCH_3)_3$, $CF_3(CF_2)_7CH_2CH_2Si(OCH_3)_3$, $CF_3(CF_2)_9CH_2CH_2Si(OCH_3)_3$, $CF_3(CF_2)_7CH_2CH_2Si(OC_2H_5)_3$, and $CF_3(CF_2)_7CH_2CH_2Si(CH_3)(OCH_3)_2$. The ones each having a fluoroalkyl group with a carbon chain length of 6 to 10 carbon atoms are preferred. These compounds may be used alone, or in combination of two or more thereof.

An organosilicon-containing compound having a hydrolyzable reactive group at a terminal thereof such as fluoroalkyl silane can be prepared as a surface treatment agent by being mixed and dispersed with an adequate hydrolytic catalyst in an organic solvent.

The hydrolytic catalysts used may be, for example, strong acid or strong alkali catalysts, fatty acid metal salts, metal alkoxides, and further aminoalkyl group-containing silane. These catalysts may be used alone, or in combination with two or more thereof.

Specific examples of the strong acid or strong alkali catalyst as above include inorganic acids such as hydrochloric acid, nitric acid, sulfuric acid, and phosphoric acid, organic acids such as formic acid, acetic acid, oxalic acid, sulfonic acid, acetic anhydride, and benzoic acid, inorganic bases such as ammonia, sodium hydroxide, and potassium hydroxide, and organic bases such as ethylenediamine and triethanolamine. Of these, inorganic acids and organic acids are preferred, and hydrochloric acid and nitric acid are particularly preferred because good pot life and water repellency can be obtained.

Some thermal heads have no suitability with strong acids and strong bases due to their materials. In such a case, the aforementioned fatty acid metal salt, metal alkoxide, or aminoalkyl group-containing silane is preferably used as a hydrolytic catalyst.

Specific examples of the fatty acid metal salt include metal soaps and fatty acid organometal salts. Of these, fatty acid organotin salts are preferred. Examples of the fatty acid organotin salts include dialkyl tin dialkanoate, and alkyl tin trialkanoate. Of these, dialkyl tin dialkanoate is preferred. Examples of dialkyl tin dialkanoate include dibutyltin dilaurate, dibutyltin diacetate, dioctyltin dilaurate, dioctyltin diacetate, dimethyltin dilaurate, and dimethyltin diacetate. Of these, dibutyltin dilaurate is particularly referred.

Specific examples of the metal alkoxide include titanium alkoxide, iron alkoxide, and organotin alkoxide. Of these, titanium alkoxide is preferred. Examples of the titanium alkoxide include tetraethyl titanate, tetrabutyl titanate, and tetraisopropyl titanate. Of these, tetraisopropyl titanate is particularly preferred. Examples of the iron alkoxide include iron octylate. Examples of the organotin alkoxide include dibutyltin dioctylate, methyltin trioctylate, and dioctyltin dioctylate.

The aforementioned aminoalkyl group-containing silane is a compound represented by the following general formula (2):

$$R^1SiR^2_qY_{3-q} \quad (2)$$

(where $R^2$ is a monovalent hydrocarbon group; Y is an alkoxy group; $R^1$ is an aminoalkyl group; and q is an integer of 0 to 2.)

Specific examples of the monovalent hydrocarbon group represented by $R^2$ in the aminoalkyl group-containing silane of the above general formula (2) include the same groups as R in the above general formula (1). Especially, a methyl group is preferred. Examples of the alkoxy group represented by Y include the same groups as X in the above general formula (1). Of these, a methoxy group and an ethoxy group are preferred, and a methoxy group is particularly preferred. Examples of the aminoalkyl group represented by $R^1$ include β-aminoethyl group, γ-aminopropyl group, δ-aminobutyl group, N-(β-aminoethyl)aminomethyl group, and N-(β-aminoethyl)-γ-aminopropyl group. Further, q is preferably 0 or 1 because the resulting coating has good water repellency.

Specific examples of the aminoalkyl group-containing silane include $H_2N(CH_2)_3Si(OCH_3)_3$, $H_2N(CH_2)_2NH$ $(CH_2)_3Si(OC_2H_5)_3$, $H_2N(CH_2)_3Si(CH_3)(OC_2H_5)_2$, $H_2N(CH_2)_3Si(OC_2H_5)_3$, and $H_2N(CH_2)_2NH(CH_2)_3Si(CH_3)(OC_2H_5)_2$.

The aforementioned organic solvent has no particular restriction so long as it can dissolve or disperse the above-mentioned organosilicon-containing compounds and hydrolytic catalysts. However, anhydrous solvents containing alcohols as main components are preferred. Specific examples thereof include alcohols such as methanol, ethanol, isopropyl alcohol, n-propyl alcohol, and n-butyl alcohol, ether alcohols and ethers such as ethylene glycol monomethyl ether, ethylene glycol monoethyl ether, propylene glycol monomethyl ether, tetrahydrofuran, and dioxane, ketones such as acetone and methyl ethyl ketone, esters such as methyl acetate and ethyl acetate, aliphatic hydrocarbons such as n-hexane, gasoline, and mineral spirits, aromatic hydrocarbons such as benzene, toluene, and xylene, and volatile silicones such as octamethylcyclotetrasiloxane, hexamethyldisiloxane, and octamethyltrisiloxane. Of these, ether alcohols and alcohols are preferred, and ethanol and isopropyl alcohol are particularly preferred in terms of excellence in pot life and coatability of the resulting surface treatment agent. The aforementioned solvents may be used alone, or in combination of two or more thereof.

The method for preparing a composition of a surface treatment agent used in the present invention is not particularly limited. The composition can be obtained by mixing the foregoing respective components at room temperature to form a homogeneous composition. However, it is generally preferred that the composition is prepared in such a procedure that a hydrolytic catalyst is added in the final step.

The surface-treatment of the protective layer of a thermal head according to the present invention can be accomplished by coating the thermal head with the surface treatment agent, and drying it.

The method for coating the surface of the protective layer of the thermal head with the surface treatment agent is not particularly limited. For example, coating of the treatment agent can be accomplished manually using a cloth impregnated with the treatment agent. Further, it can also be accomplished with dipping, coating rollers, brush coating, a blade, or the like.

The degree of surface modification achieved by the surface treatment agent, i.e., the adhesion of the surface treatment agent to the thermal head, or the wear resistance of the resulting coat depends upon the drying temperature and treatment time after coating. The preferred drying conditions are a drying temperature of 50° C. or more and a treatment time of 30 minutes or more. The drying temperature is particularly preferred to be 60° C. or more. Further, it is needless to say that the upper limit of the drying temperature is restricted by the heat resistance of the thermal head, and the pyrolysis temperature of the surface treatment agent.

The protective layer is preferably pretreated by a pretreatment agent before surface-treated by the water- and oil-repellent and heat-resistant organosilicon-containing compound. The pretreatment agent used may be an organosilicon compound having an isocyanate group directly bonded to a silicon atom. Especially, the one which is cured at ordinary temperature can be used, and in this case, the modified protective layer surface has an improved durability.

Figure 2:
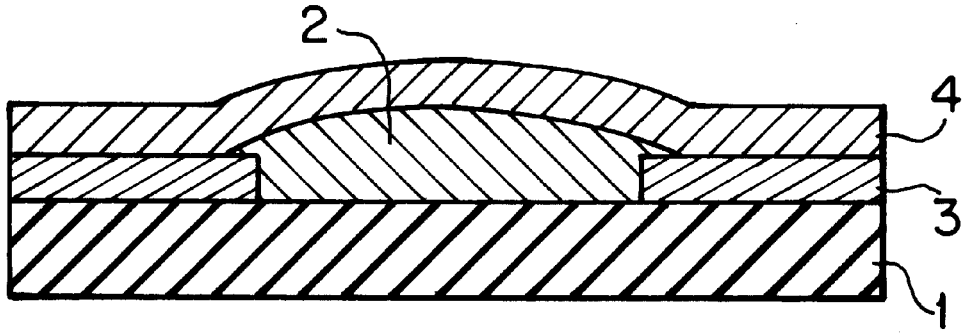
FIG. 2 is a cross sectional view of a conventional thick film type thermal head.
Figure 3:
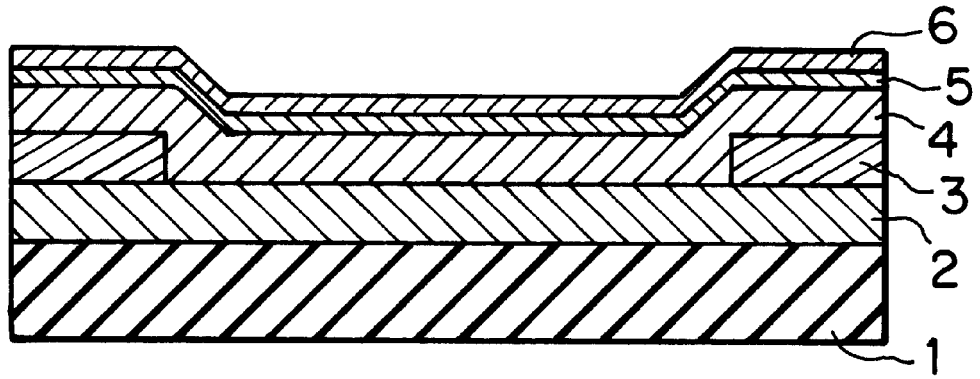
FIG. 3 is a cross sectional view of a thermal head showing a preferred embodiment of the present invention.

The pretreatment process can be accomplished, for example, in the following manner. As shown in FIG. 3 in which the numerals 1 to 4 respectively denote the same elements as in FIGS. 1 and 2, a coating solution containing an organosilicon compound having an isocyanate group directly bonded to a silicon atom as a main component is applied onto the protective layer 4, and dried at ordinary temperature. Thus, a silica base layer 5 (primary coat) with a high surface activity is formed on the protective layer 4. Accordingly, the adhesion between the protective layer 4 (the lower side of the primary coat) and the water- and oil-repellent layer 6 (the upper side of the primary coat) can be enhanced. In this case, high temperature calcination is not necessarily required, and ordinary or relatively low temperature calcination can provide a film with a sufficient hardness. Further, the thickness of the resulting film can be appropriately selected by adjustment of the coating solution, and the like. In these respects, this process is advantageous from a processability viewpoint. Thus, a desired silica base layer (primary coat) can be formed with ease and efficiency.

Examples of the organosilicon compound having an isocyanate group directly bonded to a silicon atom include organosilicon compounds represented by the following general formula (3):

$$R_{4-m}Si(NCO)_m \quad (3)$$

where m is an integer of 3 or 4, and R is a monovalent hydrocarbon group.

Examples of the compound represented by the above general formula (3) include tetraisocyanate silane [$Si(NCO)_4$] and monomethyltriisocyanate silane [$CH_3Si(NCO)_3$]. Tetraisocyanate silane is preferred because good constitutive property is provided.

The organosilicon compound having an isocyanate group directly bonded to a silicon atom is preferably used in the form of a coating solution prepared by being mixed with an adequate organic solvent. Such organic solvents have no particular restriction so long as they can dissolve the organosilicon compounds represented by the above general formula (3) with stability. However, anhydrous solvents containing esters as main components are desirable. Specific examples thereof include esters such as ethyl acetate and butyl acetate, ketones such as acetone and methyl isobutyl ketone, and aromatic hydrocarbons such as toluene and xylene. Of these, the optimum organic solvent can be appropriately selected based on the film-forming method, or the film thickness and the manufacturing conditions of the objective article.

The coating solution is preferably prepared by mixing the silicon compound represented by the general formula (3) and an organic solvent in a ratio of 1:4 to 1:999 (on a weight basis). These composition ratios can be appropriately selected based on the film-forming method, or the film thickness and the manufacturing conditions of the objective article.

The lower surface tension of the thermal head surface may be achieved in the following manner by the surface treatment method of the present invention including this pretreatment process. A coating solution A containing an organosilicon compound having an isocyanate group directly bonded to a silicon atom as a main component is prepared as a pretreatment agent. Further, a coating solution a containing an organosilicon compound having a water- and oil-repellent and heat-resistant fluoroalkyl group as a main component is prepared. The surface of the protective layer of the thermal head is coated with the coating solution A, and dried at ordinary temperature to form a film. The coating solution B is then applied onto the resulting film, and dried.

The method for successively coating the surface of the protective layer of the thermal head with the coating solutions A and B is not particularly limited. For example, the coating can be accomplished manually by a cloth impregnated with each coating solution. Further, it can be accomplished with dipping, coating roller, brush coating, a blade, or the like.

The adhesion to the protective layer or the wear resistance of the primary coat resulting from the treatment of the coating solution A depends upon the drying temperature and the treatment time after coating. However, high temperature calcination is not necessarily required thanks to the characteristics of the primary coat formed, and ordinary temperature or relatively low temperature calcination provides a film with a sufficient hardness. Actually, a treatment for about 6 hours at ordinary temperature can provide a practical hardness.

The degree of the surface modification obtained by the coating solution X, i.e., the adhesion to the primary coat or the wear resistance of the surface modified layer depends on the drying temperature and the treatment time after coating. However, preferred drying conditions are the same as in the case where no primary coat is formed.

EXAMPLES

Below, the present invention will be described in details by way of examples, which should not be construed as limiting the scope of the present invention. It is noted that "part" denotes "part by weight" in the following examples.

Example 1

Two parts of heptadecafluorodecyltrimethoxy silane [$CF_3(CF_2)_7CH_2CH_2Si(OCH_3)_3$] as fluoroalkyl silane was added to and mixed with 97 parts of isopropyl alcohol. Further, 1 part of nitric acid (at a concentration of 61%) was added thereto and homogeneously mixed therewith as a hydrolytic catalyst to prepare a surface treatment agent.

A thermal head having a protective layer comprised of a Ta—$SiO_2$ sputter layer was prepared. The surface of the protective layer was washed with alcohol, and then coated with the surface treatment agent obtained above by a cloth impregnated with the treatment agent, followed by air-drying for 10 minutes at room temperature. Thereafter, the thermal head was placed in a 70° C. thermostatic chamber, and subjected to a heat-treatment for 30 minutes to manufacture a thermal head with a modified protective layer.

The thermal head thus surface-treated was subjected to the following performance tests. The results are shown in Table 1.

Example 2

A surface treatment agent was prepared to manufacture a thermal head with a modified protective layer in the same manner as in Example 1, except that heneicosafluorododecacyltrimethoxy silane [$CF_3(CF_2)_9CH_2CH_2Si\ (OCH_3)_3$] was used in place of heptadecafluorodecyltrimethoxy silane [$CF_3(CF_2)_7CH_2CH_2Si(OCH_3\ )_3$] as fluoroalkyl silane.

The surface-treated thermal head was subjected to the following performance tests. The results are shown in Table 1.

Example 3

A surface treatment agent was prepared to manufacture a thermal head with a modified protective layer in the same manner as in Example 1, except that tridecafluorooctyltrimethoxy silane [$CF_3(CF_2)_5CH_2CH_2Si(OCH_3)_3$] was used in place of heptadecafluorodecyltrimethoxy silane [$CF_3(CF_2)_7CH_2CH_2Si(OCH_3)_3$] as fluoroalkyl silane.

The surface-treated thermal head was subjected to the following performance tests. The results are shown in Table 1.

Example 4

A surface treatment agent was prepared to manufacture a thermal head with a modified protective layer in the same manner as in Example 1, except that 0.1 part of γ-aminopropyltrimethoxy silane [$H_2N(CH_2)_3Si(OCH_3)_3$] was used in place of the nitric acid of Example 1.

The surface-treated thermal head was subjected to the following performance tests. The results are shown in Table 1.

Example 5

A surface treatment agent was prepared to manufacture a thermal head with a modified protective layer in the same manner as in Example 1, except that 0.5 part of dibutyltin laurate was used in place of the nitric acid of Example 1.

The surface-treated thermal head was subjected to the following performance tests. The results are shown in Table 1.

Example 6

A thermal head with a modified protective layer was manufactured in the same manner as in Example 1, except that the heat-treatment temperature in the thermostatic chamber was changed to 50° C.

The surface-treated thermal head was subjected to the following performance tests. The results are shown in Table 1.

Example 7

A thermal head with a modified protective layer was manufactured in the same manner as in Example 1, except that the heat-treatment temperature in the thermostatic chamber was changed to 100° C.

The surface-treated thermal head was subjected to the following performance tests. The results are shown in Table 1.

Example 8

One part of tetraisocyanate silane [$Si(NCO)_4$] was added to and mixed with 49 parts of ethyl acetate [$CH_3COOC_2H_5$] to prepare a coating solution A (pretreatment agent).

Two parts of heptadecafluorodecyltrimethoxy silane as fluoroalkyl silane was added to and mixed with 97 parts of isopropyl alcohol. Further, 1 part of nitric acid (at a concentration of 61%) was added thereto and homogeneously mixed therewith as a hydrolytic catalyst to prepare a coating solution B (surface treatment agent).

A thermal head having a protective layer comprised of a Ta—$SiO_2$ sputter layer was prepared. The surface of the protective layer was washed with alcohol, and then coated with the coating solution A obtained above by a cloth impregnated with the coating solution A, and dried for about 6 hours at room temperature to form a primary coat serving as a silica base. An wear resistance test was carried out by a pencil hardness test for the resulting primary coat. This indicates that a hard film with a pencil hardness of about H7 can be provided when the aforementioned ratio of the coating solution A is 1:49.

The surface of the primary coat of the silica base formed with the coating solution A was coated with the coating solution B obtained above by a cloth impregnated with the coating solution X, followed by air-drying for 10 minutes at room temperature. Thereafter, the thermal head was placed in a 70° C. thermostatic chamber, and subjected to a heat-treatment for 30 minutes to manufacture a surface-modified thermal head.

The thermal head thus surface-treated was subjected to the following performance tests. The results are shown in Table 1.

Example 9

The same primary coat as in Example 8 was formed onto the same thermal head as in Example 8.

The same evaluation as in Example 8 was performed. As a result, the primary coat was found to be the same hard film as in Example 8.

Subsequently, the coating solution B was prepared to manufacture a surface-modified thermal head in the same manner as in Example 1, except that heneicosafluorododecacyltrimethoxy silane was used in place of heptadecafluorodecyltrimethoxy silane as fluoroalkyl silane.

The thermal head thus surface-treated was subjected to the following performance tests. The results are shown in Table 1.

Example 10

The same primary coat as in Example 8 was formed onto the same thermal head as in Example 8.

The same evaluation as in Example 8 was performed. As a result, the primary coat was found to be the same hard film as in Example 8.

Subsequently, the coating solution B was prepared to manufacture a surface-modified thermal head in the same manner as in Example 8, except that tridecafluorooctyltrimethoxy silane was used in place of heptadecafluorodecyltrimethoxy silane as fluoroalkyl silane.

The thermal head thus surface-treated was subjected to the following performance tests. The results are shown in Table 1.

Example 11

The same primary coat as in Example 8 was formed onto the same thermal head as in Example 8.

The same evaluation as in Example 8 was performed. As a result, the primary coat was found to be the same hard film as in Example 8.

The coating solution a was prepared to manufacture a surface-modified thermal head in the same manner as in Example 8, except that 0.1 part of γ-aminopropyltrimethoxy silane was used in place of the nitric acid of Example 8.

The surface-treated thermal head was subjected to the following performance tests. The results are shown in Table 1.

Example 12

The same primary coat as in Example 8 was formed onto the same thermal head as in Example 8.

The same evaluation as in Example 8 was performed. As a result, the primary coat was found to be the same hard film as in Example 8.

The coating solution B was prepared to manufacture a surface-modified thermal head in the same manner as in Example 8, except that 0.5 part of dibutyltin laurate was used in place of the nitric acid of Example 8.

The surface-treated thermal head was subjected to the following performance tests. The results are shown in Table 1.

Example 13

The same primary coat as in Example 8 was formed onto the same thermal head as in Example 8.

The same evaluation as in Example 8 was performed. As a result, the primary coat was found to be the same hard film as in Example 8.

A surface-modified thermal head was manufactured in the same manner as in Example 8, except that the heat-treatment temperature in the thermostatic chamber was changed to 50° C.

The surface-treated thermal head was subjected to the following performance tests. The results are shown in Table 1.

Example 14

The same primary coat as in Example 8 was formed onto the same thermal head as in Example 8.

The same evaluation as in Example 8 was performed. As a result, the primary coat was found to be the same hard film as in Example 8.

A surface-modified thermal head was manufactured in the same manner as in Example 8, except that the heat-treatment temperature in the thermostatic chamber was changed to 100° C.

The surface-treated thermal head was subjected to the following performance tests. The results are shown in Table 1.

Comparative Example 1

The same untreated thermal head as in Example 1 was directly subjected to the following performance tests without being surface-treated. The results are shown in Table 1.

Comparative Example 2

From the same thermal head as in Example 1, the low heat resistance electronic components attached thereto were removed. Then, the protective layer surface of the thermal head was coated with a dispersion containing solid polytetrafluoroethylene, and predried at room temperature, followed by a heat-treatment at about 350° C. Consequently, a thermal head with the protective layer coated with a resin layer comprised of polytetrafluoroethylene was obtained.

Performance test

Each of the thermal heads obtained in Examples 1 to 14 and Comparative Examples 1 and 2 was fitted in a rotary stencil printing apparatus "RISOGRAPH (registered trademark)" TR-153 manufactured by Riso Kagaku Corporation, to evaluate the performance of each thermal head based on the following evaluation items.

Evaluation items (1) Film perforatability: a solid printing plate was made from a heat-sensitive stencil sheet to measure the number of defective perforations per unit perforation number and calculate the occurrence ratio of the number of defective perforations. Thus, the film perforatability was evaluated in accordance with the following criteria for evaluation.

Criteria for evaluation

○ less than 5%

Δ between 5% inclusive and 10% exclusive

X 10% or more (2) Thermal head contamination: the level of contamination of the thermal head surface was visually observed after continuous plate-making of heat-sensitive stencil sheets in a length of about 1000 m or 3000 m. Thus, the adhesion preventability of a thermal melt was evaluated in accordance with the following criteria for evaluation.

Criteria for evaluation

○ no contamination

Δ slightly contaminated

X contaminated (3) Contact angle: each contact angle of the thermal head surface with respect to purified water immediately after the surface treatment processing (at an earlier stage), and after continuous plate-making of heat-sensitive stencil sheets in a length of about 1000 m or 3000 m was measured to be taken as an indication of preventability of adhesion of thermal melt to the thermal head surface and the wear resistance of the surface treatment agent.

solutions after forming a primary coat thereon with the coating solution A (Examples 8 to 14) are compared with the thermal head obtained by directly coating the protective layer surface thereof with the coating solution B (Example 1). This comparison shows that the former thermal heads are less contaminated after long-term continuous plate-making, and more excellent in durability with good adhesion preventability of the melt of the thermoplastic resin film.

With the thermal head of the present invention, the surface of the protective layer of the thermal head is modified into a low surface free energy state by a water- and oil-repellent and heat-resistant compound such as fluoroalkyl silane. Accordingly, the adhesion of the thermal melt of the ther-

TABLE 1

| | Coating solution A (Pretreatment agent) Presence of primary coat | Coating solution B (Surface treatment agent) Heat-treatment temperature | Component A | Component B | Component C | Contact angle Early Stage | After 1000 m plate-making | After 3000 m plate-making | Film perforatability | Thermal head contamination after continuous plate-making After 1000 m plate-making | After 3000 m plate-making |
|---|---|---|---|---|---|---|---|---|---|---|---|
| Ex. 1 | NO | 70° C. | A1 | B1 | IPA | 108° | 98° | 85° | ○ | ○ | X |
| Ex. 2 | NO | 70° C. | A2 | B1 | IPA | 113° | 99° | — | ○ | ○ | — |
| Ex. 3 | NO | 70° C. | A3 | B1 | IPA | 105° | 95° | — | ○ | Δ | — |
| Ex. 4 | NO | 70° C. | A1 | B2 | IPA | 107° | 96° | — | ○ | ○ | — |
| Ex. 5 | NO | 70° C. | A1 | B3 | IPA | 108° | 98° | — | ○ | ○ | — |
| Ex. 6 | NO | 50° C. | A1 | B1 | IPA | 103° | 95° | — | ○ | Δ | — |
| Ex. 7 | NO | 100° C. | A1 | B1 | IPA | 111° | 99° | — | ○ | ○ | — |
| Ex. 8 | YES | 70° C. | A1 | B1 | IPA | 110° | 106° | 100° | ○ | ○ | ○ |
| Ex. 9 | YES | 70° C. | A2 | B1 | IPA | 113° | 108° | 102° | ○ | ○ | ○ |
| Ex. 10 | YES | 70° C. | A3 | B1 | IPA | 105° | 102° | 97° | ○ | ○ | Δ |
| Ex. 11 | YES | 70° C. | A1 | B2 | IPA | 107° | 102° | 99° | ○ | ○ | ○ |
| Ex. 12 | YES | 70° C. | A1 | B3 | IPA | 108° | 105° | 101° | ○ | ○ | ○ |
| Ex. 13 | YES | 50° C. | A1 | B1 | IPA | 103° | 103° | 98° | ○ | ○ | Δ |
| Ex. 14 | YES | 100° C. | A1 | B1 | IPA | 111° | 107° | 102° | ○ | ○ | ○ |
| CE. 1 | NO | No surface treatment | | | | 70° | 71° | 71° | ○ | X | X |
| CE. 2 | NO | Surface polytetrafluoroethylene treated | | | | 105° | 105° | 104° | X | ○ | ○ |

Notes: CE: Comparative Example,
Component A: fluoroalkyl silane,
A1: $CF_3(CF_2)_7CH_2CH_2Si(OCH_3)_3$
A2: $CF_3(CF_2)_9CH_2CH_2Si(OCH_3)_3$
A3: $CF_3(CF_2)_5CH_2CH_2Si(OCH_3)_3$
Component B: hydrolytic catalyst,
B1: nitric acid (61% concentration)
B2: $H_2N(CH_2)_3Si(OCH_3)_3$
B3: dibutyltin laurate
Component C: organic solvent
IPA: isopropyl alcohol Apparent from Table 1, the thermal heads surface-treated according to the present invention (Examples 1 to 7) undergo less contamination after continuous plate-making than in the case of the untreated thermal head (Comparative Example 1), and the melt of a thermoplastic resin film is less likely to adhere thereto. Further, they are more excellent in film perforatability than a conventional thermal head with a polytetrafluoroethylene resin layer (Comparative Example 2). This indicates that the surface treatment according to the present invention does not inhibit the heat transferability from the heat-generating resistor to the surface. As indicated from the comparison of Examples 1 and 2 with Example 3, it is particularly preferred to use the compound having a fluoroalkyl group of 8 or more carbon atoms as fluoroalkyl silane. Further, as indicated from the comparison of Examples 1 and 7 with Example 6, it is particularly preferred that the heat-treatment temperature is set to be 70° C. or more.

Further, the thermal heads each modified to have a water- and oil-repellent surface by being coated with the coating moplastic resin film arising in the plate-making process of heat-sensitive stencil sheets, or the like can be effectively prevented. The surface of the modified protective layer is only covered with a very thin coat on a molecular level made of the aforementioned compound. Therefore, the modified protective layer will not reduce the heat transfer efficiency from the heat-generating resistor to the protective layer surface of the thermal head, and also will not inhibit the adhesion between the thermoplastic resin film to be perforated and the thermal head. Accordingly, it is suitable for plate-making of heat-sensitive stencil sheets, and also applicable to a thermal transfer printer and a thermal printer. Further, the surface treatment method of the present invention enables the aforementioned coat to be firmly bonded to the protective layer surface only by the heat-treatment at relatively low temperature. Therefore, the method has a low risk of damaging the electronic components of the thermal head, and can be carried out with ease.

When a silica base layer (primary coat) is formed on the protective layer surface of the thermal head, and the top thereof is then surface-treated with a water- and oil-repellent and heat-resistant compound, the modified layer formed on the protective layer of the thermal head has a two-layered structure of the primary coat and the layer with water- and oil-repellency and heat resistance. Both of the two layers are very thin coats, and hence heat transfer efficiency from the resistor up to the protective layer surface of the thermal head is not reduced. Further, only the relatively low temperature heat-treatment enables the aforementioned two-layered coat to be firmly bonded to the protective layer surface. Therefore, this process has a low risk of damaging the electronic components of the thermal head, and can be carried out with ease.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A method of plate-making of a heat-sensitive stencil sheet, comprising:

providing a thermal head having a coating of a protective layer containing a water- and oil-repellent and heat-resistant organosilicon-containing compound having a hydrolyzable reactive group at a terminal thereof in the presence of a hydrolytic catalyst and using the thermal head in plate making of the heat sensitive stencil sheet.

2. The plate-making method according to claim 1, further comprising a step of heating said thermal head to 50° C. or more.

3. The plate-making method according to claim 1, wherein said organosilicon-containing compound is a fluoroalkyl silane.

4. The plate-making method according to claim 1, wherein said protective layer is pretreated with a pretreatment agent, and said organosilicon-containing compound is applied onto the pretreated surface.

5. The plate-making method according to claim 4, wherein said pretreatment agent is an agent containing an organosilicon compound having an isocyanate group directly bonded to a silicon atom as a main component.

6. The plate-making method according to claim 5, wherein said organosilicon compound having an isocyanate group directly bonded to a silicon atom is represented by the following general formula:

$$R_{4-m}Si(NCO)_m$$

(where m is an integer of 3 or 4, and R is a monovalent hydrocarbon group).

7. The plate-making method according to claim 6, wherein said organosilicon compound having an isocyanate group directly bonded to a silicon atom is a tetraisocyanate silane represented by the following general formula:

$$Si(NCO)_4.$$

8. A thermal head comprising:

an insulation substrate;

a heat-generating resistor provided on said insulation substrate;

a conductive layer connected to said heat-generating resistor for supplying electric power thereto; and a protective layer provided on said heat-generating resistor and said conductive layer, wherein said protective layer is surface-treated with a water- and oil-repellent and heat-resistant organosilicon-containing compound, wherein a surface of said surface-treated protective layer has a contact angle with respect to water of at least 95 degrees.

9. The thermal head according to claim 4, wherein said thermal head is for use in plate-making of a heat-sensitive stencil sheet.

10. A thermal head comprising:

an insulation substrate;

a heat-generating resistor provided on said insulation substrate;

a conductive layer connected to said heat-generating resistor for supplying electric power thereto; and a protective layer provided on said heat-generating resistor and said conductive layer, wherein said protective layer is surface-treated with a water- and oil-repellent and heat-resistant organosilicon-containing compound, wherein said water- and oil-repellent and heat-resistant organosilicon-containing compound is a fluoroalkyl silane having a hydrolyzable reactive group at a terminal thereof.

11. The thermal head according to claim 10, wherein said fluoroalkyl silane has a fluorinated carbon chain length of 6 to 10 carbon atoms.

12. The thermal head according to claim 10, wherein said fluoroalkyl silane has a fluorinated carbon chain length of 8 to 10 carbon atoms.

13. The thermal head according to claim 10, wherein said thermal head is for use in plate-making of a heat-sensitive stencil sheet.

14. A thermal head comprising:

an insulation substrate;

a heat-generating resistor provided on said insulation substrate;

a conductive layer connected to said heat-generating resistor for supplying electric power thereto; and a protective layer provided on said heat-generating resistor and said conductive layer, wherein said protective layer is surface-treated with a water- and oil-repellent and heat-resistant organosilicon-containing compound, wherein a surface of said protective layer is pretreated with a pretreatment agent, and said surface treatment is conducted on the pretreated surface.

15. The thermal head according to claim 14, wherein said pretreatment agent is an agent containing an organosilicon compound having an isocyanate group directly bonded to a silicon atom as a main component.

16. The thermal head according to claim 15, wherein said organosilicon compound having an isocyanate group directly bonded to a silicon atom is represented by the following general formula:

$$R_{4-m}Si(NCO)_m$$

(where m is an integer of 3 or 4, and R is a monovalent hydrocarbon group).

17. The thermal head according to claim 16, wherein said organosilicon compound having an isocyanate group directly bonded to a silicon atom is tetraisocyanate silane represented by the following general formula:

$$Si(NCO)_4.$$

18. The thermal head according to claim 14, wherein said thermal head is for use in plate-making of a heat-sensitive stencil sheet.

19. A method of perforating a heat sensitive stencil sheet, comprising:

providing a thermal head having an insulation substrate, a heat-generating resistor provided on said insulation substrate, a conductive layer connected to said heat-generating resistor for supplying electric power thereto, and a protective layer provided on said heat-generating resistor and said conductive layer, wherein said protective layer is surface-treated with a water- and oil-repellent and heat-resistant organosilicon-containing compound; and using the thermal head to perforate the heat sensitive stencil sheet.

20. A surface treatment method of a thermal head having a protective layer, comprising:

coating the protective layer of the thermal head with a water- and oil-repellent and heat-resistant organosilicon-containing compound having a hydrolyzable reactive group at a terminal thereof in the presence of a hydrolytic catalyst, wherein the organosilicon-containing compound is a fluoroalkyl silane.

21. The surface treatment method according to claim 20, further comprising a step of heating said thermal head to 50° C. or more.

22. The surface treatment method according to claim 20, wherein said protective layer is pretreated with a pretreatment agent, and said organosilicon-containing compound is applied onto the pretreated surface.

23. The surface treatment method according to claim 22, wherein said pretreatment agent is an agent containing an organosilicon compound having an isocyanate group directly bonded to a silicon atom as a main component.

24. The surface treatment method according to claim 23, wherein said organosilicon compound having an isocyanate group directly bonded to a silicon atom is represented by the following general formula:

$$R_{4-m}Si(NCO)_m$$

(where m is an integer of 3 or 4, and R is a monovalent hydrocarbon group).

25. The surface treatment method according to claim 24, wherein said organosilicon compound having an isocyanate group directly bonded to a silicon atom is a tetraisocyanate silane represented by the following general formula:

$$Si(NCO)_4.$$

* * * * *